US010744809B2

(12) United States Patent
Raccanello

(10) Patent No.: US 10,744,809 B2
(45) Date of Patent: Aug. 18, 2020

(54) MULTIFUNCTIONAL ROTARY TOOL FOR BOOKBINDING MACHINES AND A BOOKBINDING MACHINE

(71) Applicant: K.G.S. S.R.L. UNIPERSONALE, Mestrino (IT)

(72) Inventor: Roberto Raccanello, Padua (IT)

(73) Assignee: K.G.S. S.R.L. UNIPERSONALE, Mestrino (PD) (IT)

( * ) Notice: Subject to any disclaimer, the term of this patent is extended or adjusted under 35 U.S.C. 154(b) by 99 days.

(21) Appl. No.: 16/085,764

(22) PCT Filed: Mar. 23, 2017

(86) PCT No.: PCT/IB2017/051677
§ 371 (c)(1),
(2) Date: Sep. 17, 2018

(87) PCT Pub. No.: WO2017/163206
PCT Pub. Date: Sep. 28, 2017

(65) Prior Publication Data

US 2019/0092072 A1 Mar. 28, 2019

(30) Foreign Application Priority Data

Mar. 24, 2016 (IT) ..... 102016000031091

(51) Int. Cl.
*B42C 5/04* (2006.01)

(52) U.S. Cl.
CPC ..... *B42C 5/04* (2013.01)

(58) Field of Classification Search
CPC ..... B23C 2240/32; B23C 5/24; B42C 5/04
(Continued)

(56) References Cited

U.S. PATENT DOCUMENTS 7,373,707 B2 * 5/2008 Ouchiyama ..... B42C 5/04 270/58.08
7,736,099 B2 * 6/2010 Cole ..... B23C 5/223 407/66

(Continued)

FOREIGN PATENT DOCUMENTS

CH 303 678 A 12/1954
DE 27 19 402 A1 11/1978

(Continued)

*Primary Examiner* — Andrea L Wellington
*Assistant Examiner* — Liang Dong
(74) *Attorney, Agent, or Firm* — R. Neil Sudol; Henry D. Coleman

(57) ABSTRACT

A multifunction rotary tool for milling and roughening backs of blocks of pages to be bound by a bookbinding machine comprises a cylindrical base defining a rotation axis, a first annular member adapted to be secured to the cylindrical base and having an outer edge, a crown of milling blades formed in the first annular member proximate to its outer edge and defining a cutting plane perpendicular to the rotation axis, and a plurality of roughening inserts securable to the cylindrical base along a circular area radially offset from the crown of milling blades. Each insert comprises a cylindrical body with a hook-shaped end portion defined by an upper edge with a sharp tip designed to penetrate the block back in a perpendicular cut. The end portion comprises a recessed surface adapted to tear and push downwards the cut material without removing it.

11 Claims, 3 Drawing Sheets

(58) Field of Classification Search
USPC ..... 83/875, 879, 917; 407/66
See application file for complete search history.

(56) References Cited

U.S. PATENT DOCUMENTS

| | | | | |
|---|---|---|---|---|
| 2009/0035075 | A1* | 2/2009 | Hecht | B23B 27/1622 407/104 |
| 2013/0294854 | A1* | 11/2013 | Lee | B23B 27/16 407/101 |

FOREIGN PATENT DOCUMENTS

| | | | | |
|---|---|---|---|---|
| DE | 196 50 851 | A1 | 5/1998 | |
| DE | 100 22 836 | A1 | 11/2001 | |
| DE | 102011105033 | A1 * | 12/2012 | B42C 5/04 |
| EP | 1 378 373 | A1 | 1/2004 | |

* cited by examiner

MULTIFUNCTIONAL ROTARY TOOL FOR BOOKBINDING MACHINES AND A BOOKBINDING MACHINE

FIELD OF THE INVENTION

The present invention generally finds application in the field of bookbinding and particularly relates to a multifunctional rotary tool for bookbinding machines.

The invention further relates to a bookbinding machine comprising the above rotary device.

BACKGROUND ART

In the field of printing and bookbinding, devices and tools are known for processing the backs of blocks of sheet elements before applying an adhesive layer thereto for gluing a cover.

Generally, these devices and tools comprise a support that is adapted to rotate about a substantially vertical axis and to be coupled to a motorized spindle and an annular member that can be secured to the base and comprises a crown of milling blades formed on its outer edge.

During rotation of the support base, the blades mill the sheet elements of the block as it is being fed, at a cutting plane that is substantially perpendicular to the axis of rotation to flatten the sheets of the block and level the surface of the back.

A first type of tools is configured to only mill the sheets of the block. In an attempt to enhance the functions of the tool, tools have been developed which effect both milling of the sheet elements of the block and roughening of the block back, also known as notching or micro-notching.

By means of notching or micro-notching the back of the block is cut and roughed to increase the contact surface with the adhesive that is later applied to the block back before coupling with a cover.

In addition to milling blades, multifunctional tools also comprise a crown of roughening inserts that can be removably secured to the base along a circular area that is radially inwardly offset from the milling blades.

EP1378373 discloses a tool for milling and roughening the back of the block of sheet elements, which comprises a crown of roughening inserts projecting upwards from the cutting plane of the milling blades. The inserts have a prismatic body with a sharp upper edge adapted to interact with the back of the block as the base is rotated to cause cutting thereof. Furthermore, the tool comprises an additional annular member having a plurality of brushes for brushing the back of the block after the milling and notching operations.

A first drawback of this known solution is that the roughening inserts cause material removal, and damage the block portions contiguous to the back that shall not undergo this processing.

A further drawback is that the use of these inserts affords limited increase of the contact surface of the back for further application of the adhesive.

Another drawback is that the inserts interact with the block in a corresponding inclined direction, not adapted to create optimal cuts for notching.

A further drawback of this solution is that assembly and disassembly of the various parts of the tool are complex and labor-intensive operations.

Technical Problem

In view of the prior art, the technical problem addressed by the present invention consists in providing a multifunctional rotary tool for bookbinding machines that is very simple and can considerably increase the surface of the block available for application of a glue without material removal.

DISCLOSURE OF THE INVENTION

The object of the present invention is to solve the aforementioned technical problem and obviate the above drawbacks, by providing a multifunctional rotary too for bookbinding machines, that is highly efficient and relatively cost-effective.

A particular object of the present invention is to provide a multifunction rotary tool for bookbinding machines that can increase the surface of the block back available for glue application.

A further object of the present invention is to provide a multifunction rotary tool for bookbinding machines that can carry out notching and micro-notching operation without removing any material from the block back.

Another object of the present invention is to provide a multifunction rotary tool for bookbinding machines that does not damage the block portions contiguous to the back, that do not undergo notching.

Another object of the present invention is to provide a multifunctional rotary device for bookbinding machines that has simple maintenance.

These and other objects, as better explained hereafter, are fulfilled by a multifunction rotary tool for bookbinding machines as defined in claim 1, which comprises a cylindrical base adapted to be coupled to a spindle of the machine to rotate about a substantially vertical axis, a first annular member adapted to be secured to the base and having a plurality of milling blades formed on its outer edge and a plurality of roughening inserts, also adapted to be secured to the base.

Each roughening insert comprises a cylindrical body with a substantially hook-shaped end portion defined by a substantially straight upper edge with a sharp tip which is designed to penetrate the block and cut it in a direction substantially perpendicular thereto.

Furthermore, each insert comprises an at least partially curved recessed surface which is adapted to tear and push downwards the cut material of the block without removing it.

In a further aspect, the invention relates to a bookbinding machine for binding blocks of pages to be bound as defined in claim 11.

Advantageous embodiments of the invention are obtained in accordance with the dependent claims.

BRIEF DESCRIPTION OF THE DRAWINGS

Further features and advantages of the invention will be more apparent from the detailed description of a preferred, non-exclusive embodiment of a multifunction rotary tool for bookbinding machines which is described as a non-limiting example with the help of the annexed drawings, in which.

DETAILED DESCRIPTION OF A PREFERRED EXEMPLARY EMBODIMENT

Particularly referring to the figures, there is shown a multifunction rotary tool, generally designated by numeral 1, which is designed to be installed on a bookbinding machine to perform milling and roughening operations on the backs D of blocks B of pages S to be bound.

Such operations have the purpose to increase the surface of the backs D of the blocks B that is available for further application of a coat of glue, allowing a flexible cover to be attached to the backs D.

The bookbinding machine, not shown, comprises a advancement plane P for feeding the blocks B in a substantially horizontal direction L and a motorized spindle 2 with a multifunction tool 1 mounted thereon.

Conveniently, the block B may be fed by means of a motorized clamp, not shown, whose plates are adapted to retain the block B at its side walls.

In the embodiment of the figures, the multifunction tool 1 comprises a cylindrical base 3 defining a substantially vertical axis of rotation V, and adapted to be coupled to the motorized spindle 2 of the machine.

Figure 4:
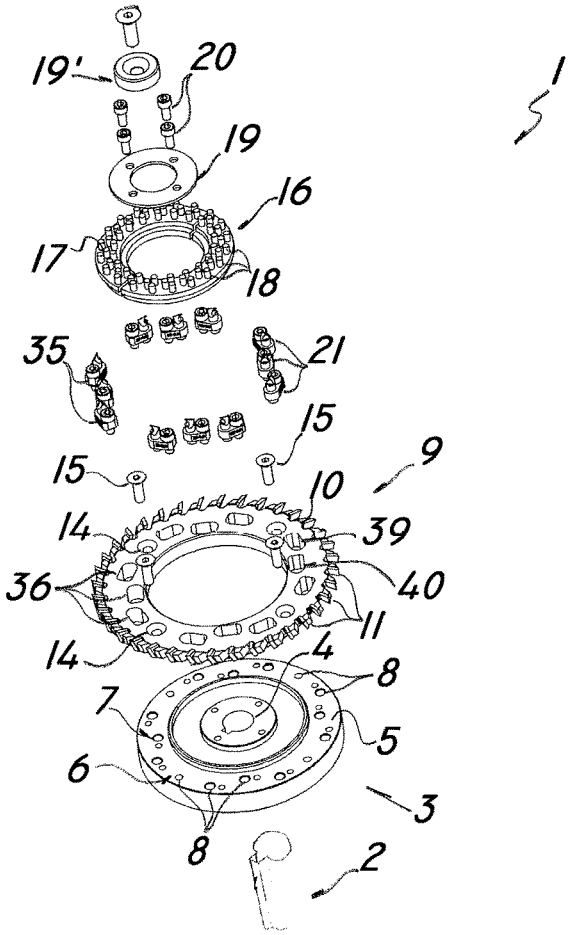
FIG. 4 is an exploded perspective view of the tool of FIG. 1.

The cylindrical base 3 may comprise a central hole 4 for receiving the spindle 2 and will be adapted to be coupled thereto by means of a key, as best shown in FIG. 4 or a tongue, a shrink disk, a square shaft, a spline shaft or other similar coupling types.

Furthermore, the cylindrical base 3 has a top surface 5 with first 6 and second 7 sets of radially and angularly offset holes.

The tool 1 further comprises a first annular member 9 that can be coaxially secured to the cylindrical base 3 and has a substantially circular outer peripheral edge 10.

As best shown in FIGS. 1 to 4, the first annular member 9 comprises a crown of milling blades 11 formed at its outer peripheral edge 10 and defining a cutting plane π substantially perpendicular to the vertical axis of rotation V.

Each of the blades 11 comprises a front cutting portion 12 and an upper cutting portion 13 which are adapted to remove the material from the back D of the block B as the latter is fed on the surface P of the machine and the cylindrical base 3 is rotated.

The first annular member 9 may comprise a plurality of through holes 14 that are angularly arranged and can be aligned with the threaded holes 8 of the first set 6, formed on the base to receive screws 15 for removably securing the first annular member 9 to the base 3.

Conveniently, a second annular member 16 may be provided, whose diameter is smaller than that of the first and can be removably secured to the cylindrical base 3.

As shown in FIGS. 1 to 4, the second annular member 16 may comprise, on its top surface 17, a plurality of brushes 18 that project upwards from the cutting plane π and are adapted to remove any processing residues from the backs D of the blocks B.

Furthermore, a pair of third central annular members 19, 19' may be provided, for maintaining the annular members 9, 16 coupled with each other and with the base 3, by means of appropriate connecting screws 20.

The multifunctional tool 1 also comprises a plurality of roughening inserts 21, as best shown in FIGS. 5A to 5E, which are adapted to be removably secured to the cylindrical base 3 along a circular area 22 that is radially inwardly offset relative to the crown of milling blades 11.

Figure 1:
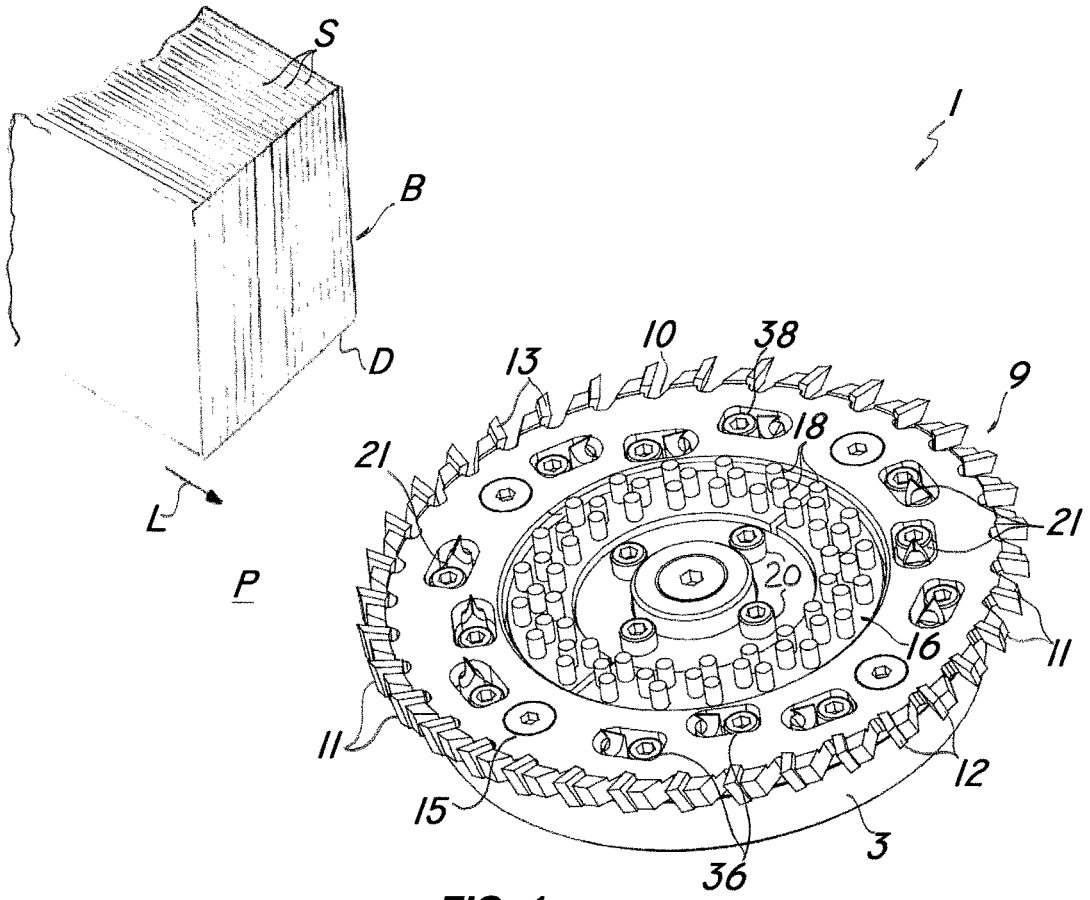
FIG. 1 is a perspective view of the multifunctional rotary tool of the invention during processing of a block of pages to be bound.
Figure 2:
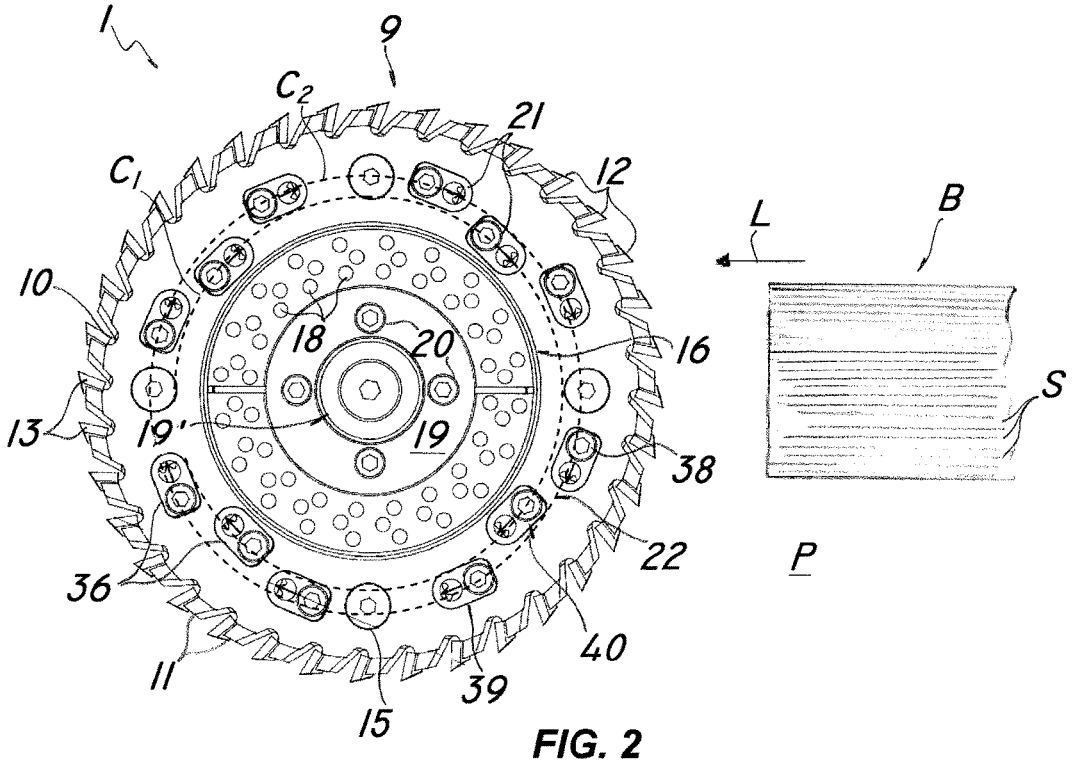
FIG. 2 is a top view of the tool of FIG. 1 during processing of the block.
Figure 3:
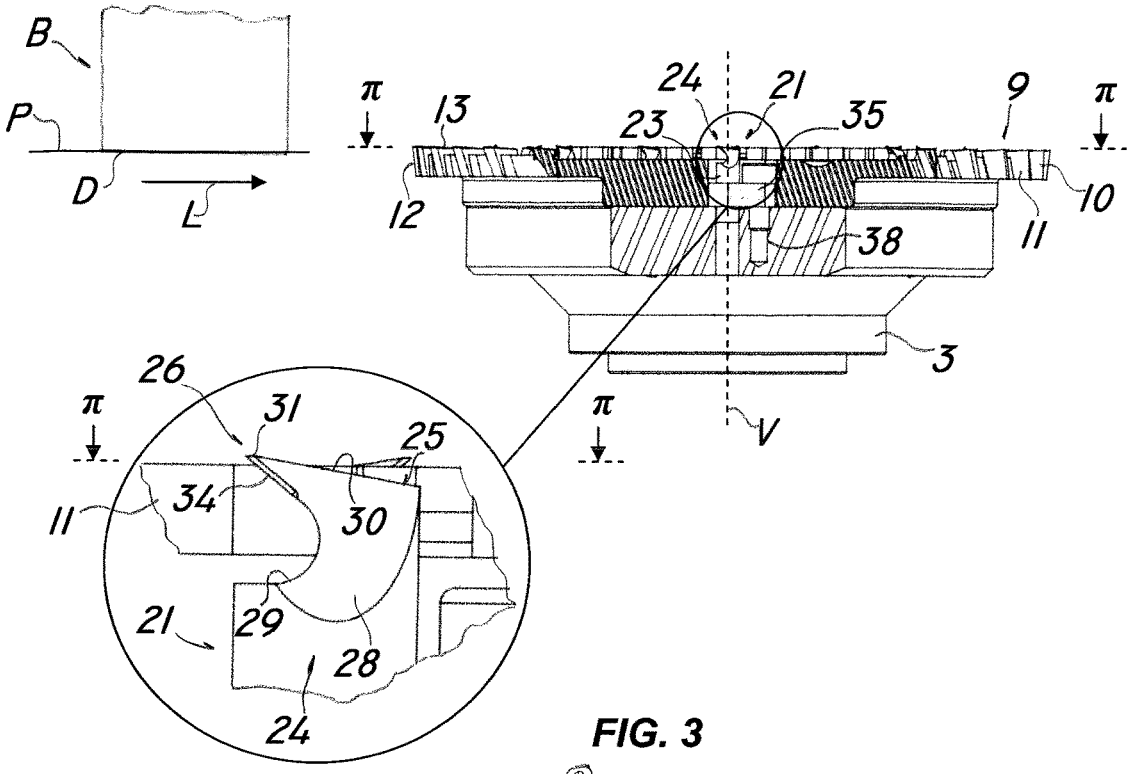
FIG. 3 is a lateral broken-away view of the tool of FIG. 1 during processing of the block with a respective magnification.

The roughening inserts 21 partially project relative to the cutting plane π of the milling blades 11, as best shown in FIG. 3, to cut the back D of the block that is being fed on the surface P of the machine as the base 3 is rotated, and may be arranged along circumferences $C_1$, $C_2$ that are substantially concentric with respect to the axis of rotation V.

Thus, the block B that is being fed along the surface P of the bookbinding machine will first interact with the milling blades 11 and then with the roughening inserts 21.

Of course, the roughening inserts 21 may be arranged along further circumferences without departure from the scope of the present invention.

According to a peculiar aspect of the invention, each roughening insert 21 comprises a cylindrical body 23 with a substantially hook-shaped end portion 24 defined by a substantially straight upper edge 25, as best shown in FIGS. 5A to 5E.

Figure 5A:
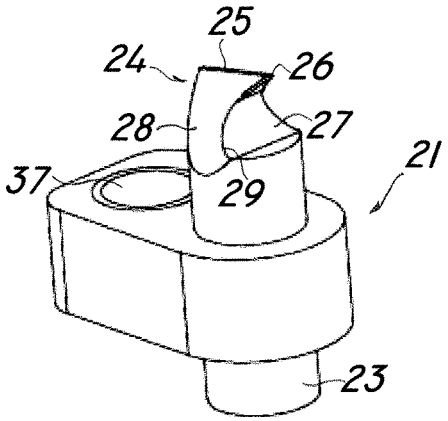
FIGS. 5A to 5E are perspective, top, enlarged perspective and lateral views respectively, with respective magnifications, of the tool of FIG. 1.
Figure 5B:
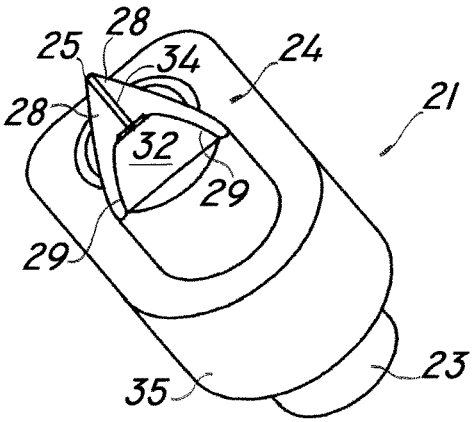
Figure 5C:
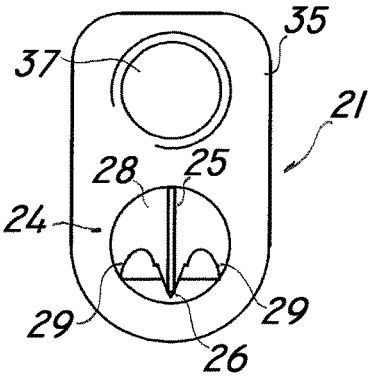
Figure 5D:
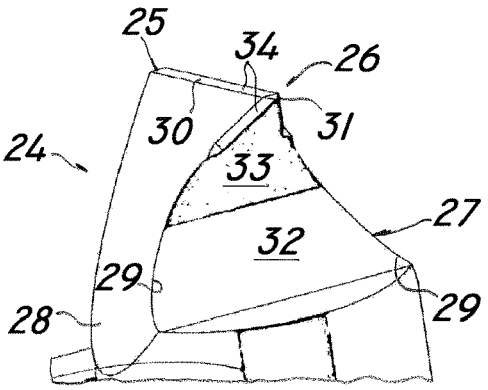

The upper edge 25 has a sharp tip 26, as best shown in FIGS. 5D and 5R, which is adapted to penetrate the back D of the block B and cut it in a direction Y substantially perpendicular thereto.

Furthermore, the end portion 24 of each roughening insert 21 comprises an at least partially curved recessed surface 27, as best shown in FIG. 5D, which is adapted to tear and push downwards the cut material without removing it.

Therefore, the multifunctional rotary tool 1 of the invention is able to mill and rough the backs D of the blocks B of pages S to be bound while considerably increasing the surface thereof that is available for application and distribution of the glue, without removing any material therefrom, and without damaging the parts of the block B contiguous to the back D, that require no processing.

Preferably, the end portion 24 of each insert 21 may comprise a pair of substantially flat side surfaces 28 which converge toward the upper edge 25 and side edges 29 defined by the intersection of the side surfaces 28 with the recessed surface 27.

Furthermore, the upper edge 25 is chamfered and has a first section 30 inclined with respect to the cutting plane π and a second section 31 substantially parallel to the cutting plane π and defining the sharp tip 26.

Particularly, as best shown in the enlargement of FIG. 3, the sharp tip 26 and part of the first inclined section 30 of the upper edge 25 will project relative to the cutting plane π of the blades 11 to interact with the back D of the block B in the direction Y perpendicular thereto.

The inclination of the inclined section 30 is selected in such a manner that, as the tool 1 rotates, each insert 21 will only interact with the back D of the block B at the sharp tip 26, thereby preventing shocks and damages to the parts of the block that are not designed to be processed.

Figure 5E:
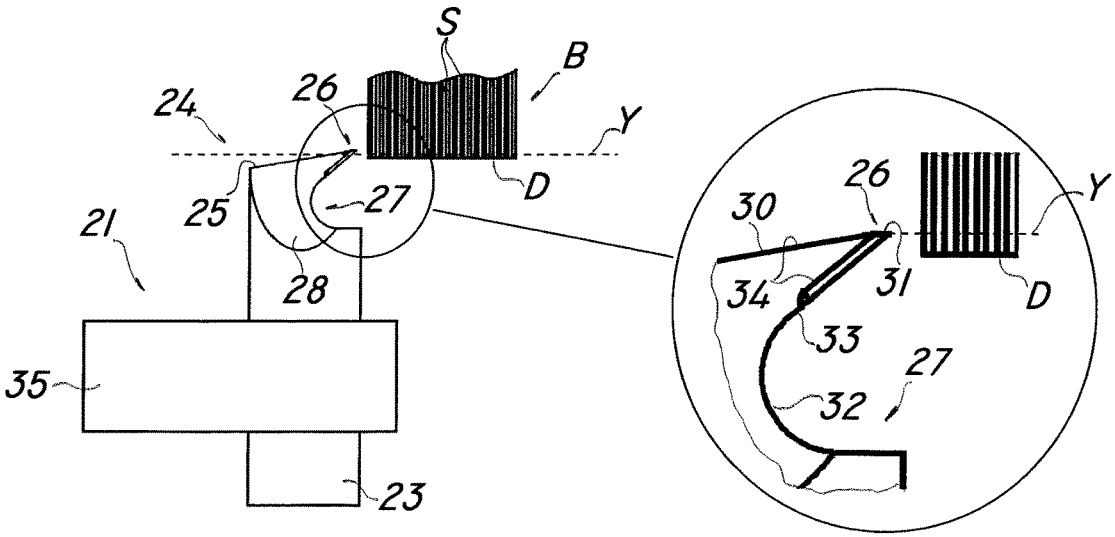

The recessed surface 27 comprises a substantially cylindrical lower portion 32 and a substantially flat and straight upper portion 33, as best shown in FIGS. 5D and 5E.

Advantageously, the side edges 29 are curved at the lower portion 32 and planar and inclined at the upper portion 33.

The bevels 34 formed at the upper edge 25 and the side edges 29 of the end portion 24 of each insert 21 eliminate the sharp edges that might cause material removal during roughening of the back D.

Conversely, the roughening inserts 21 as used in the present invention carry out notching of the backs D of blocks B by tearing the material fibers and pushing the material downwards.

Conveniently, each insert 21 comprises a support 35 having a generally prismatic shape, possibly with rounded corners, in which the cylindrical body 23 is accommodated and housed in a corresponding through cavity 36 having a mating shape, formed in the first annular member 9.

Of course, the shape of the support 35 and the cavities 36 may also be other than a prismatic shape, without departure from the scope of the present invention.

The first annular member 35 may comprise a plurality of through holes 37 that are angularly arranged and can be aligned with the threaded holes 8 of the first set 7, formed on the base to receive screws 38 for removably securing the insert member 21 to the base 3.

This feature greatly simplifies maintenance of the tool 1, as it allows replacement of damaged or worn roughening inserts 21 only, without requiring replacement of a whole crown of inserts, unlike prior art tools.

The first annular member 9 may comprise at least two series 39, 40 of through cavities 36 that are angularly offset and radially arranged in respective circular paths concentric with the axis of rotation, radially offset and corresponding to the circumferences $C_1$, $C_2$.

In the embodiment of the figures, the tool 1 has an outer series 39 having eight through cavities 36 and an inner series 40 having four through cavities 36, and each of the cavities 36 is adapted to accommodate a respective insert 21 with its corresponding support 35.

In an alternative embodiment of the invention, not shown, the roughening inserts 21 may be fitted in some of the through cavities 36, according to particular types of notching to be carried out on the backs D of blocks B.

In a further aspect, the invention relates to a bookbinding machine, not shown, for binding blocks B of packed pages S, which comprises a advancement plane P for feeding the blocks B in a substantially horizontal direction L and a load unit for loading the blocks B with the backs D lying on the advancement plane P.

The machine comprises a motorized spindle 2 with a substantially vertical axis of rotation V having the above described multifunctional rotary tool 1 mounted thereto.

The tool 1 installed in the bookbinding machine allows the backs D of the blocks to be milled using the crown of milling blades 11 and roughed using the plurality of roughening inserts 21 which are adapted to cut the material of the blocks B without removing it.

The tool and the machine of the invention are susceptible to a number of changes or variants, within the inventive concept disclosed in the appended claims. All the details thereof may be replaced by other technically equivalent parts, and the materials may vary depending on different needs, without departure from the scope of the invention.

While the tool and the machine have been described with particular reference to the accompanying figures, the numerals referred to in the disclosure and claims are only used for the sake of a better intelligibility of the invention and shall not be intended to limit the claimed scope in any manner.

INDUSTRIAL APPLICABILITY

The present invention may find application in industry, because it can be produced on an industrial scale in the publishing and bookbinding industries.

The invention claimed is:

1. A multifunction rotary tool for bookbinding machines, particularly for milling and roughening backs of blocks of pages to be bound, wherein the bookbinding machine comprises an advancement plane for feeding the blocks and a motorized spindle, wherein the tool comprises:

a cylindrical base defining an axis of rotation and adapted to be coupled to the motorized spindle of the bookbinding machine;

a first annular member designed to be coaxially secured to said cylindrical base and having a circular outer peripheral edge;

a crown of milling blades formed in said first annular member proximate to its outer peripheral edge and defining a cutting plane perpendicular to said axis of rotation;

a plurality of roughening inserts, which are adapted to be removably secured to said cylindrical base along a circular area that is radially inwardly offset relative to said crown of milling blades;

wherein each roughening insert comprises a cylindrical body with an end portion having a hook shape defined by an upper edge with a sharp tip which is designed to penetrate the back of the block and cut it along a direction perpendicular thereto, and an at least partially curved recessed surface, which is adapted to tear apart and push downwards the cut material without removing it.

2. The tool as claimed in claim 1, wherein said end portion comprises a pair of planar side surfaces which converge toward said upper edge and side edges defined by the intersection of said side surfaces with said recessed surface.

3. The tool as claimed in claim 1, wherein said upper edge is chamfered and has a first section inclined with respect to said cutting plane and a second section parallel to said cutting plane and defining said sharp tip.

4. The tool as claimed in claim 2, wherein said recessed surface comprises a cylindrical lower portion, which is joined to a planar and inclined upper portion.

5. The tool as claimed in claim 4, wherein said side edges are curved at said lower portion and straight and chamfered at said upper portion.

6. The tool as claimed in claim 1, wherein said roughening inserts are arranged along circumferences concentric with said axis of rotation.

7. The tool as claimed in claim 6, wherein each insert comprises a prismatic support with said cylindrical body inserted therein, which is shaped to be housed in a corresponding through cavity formed in said first annular member said support having through holes for respective anchor screws.

8. The tool as claimed in claim 7, further comprising at least two series of through cavities that are angularly offset in respective circular paths concentric with said axis of rotation, radially offset and corresponding to said circumferences.

9. The tool as claimed in claim 7, wherein said base comprises a first set of threaded holes for anchor screws for securing said first annular member to said base and a second set of threaded holes aligned with said through cavities for securing said inserts to said base.

10. The tool as claimed in claim 1, wherein it comprises a second annular member whose diameter is smaller than that of said first annular member and configured to be removably secured to said cylindrical base, said second annular member having a plurality of brushes projecting upwards from said cutting plane.

11. A bookbinding machine for binding blocks of packed pages, comprising an advancement plane, for feeding the blocks, a load unit for loading the blocks with the back lying on advancement plane, a motorized spindle with an axis of rotation, a tool mounted to said spindle and guide means for guiding the blocks being processed by intersecting said axis of rotation, wherein said tool is the multifunction tool as claimed in claim 1, for milling the backs of the blocks using the crown of peripheral blades and roughening the backs of the blocks using said plurality of roughening inserts to cut the material of the blocks without removing it.

* * * * *